US008648532B2

(12) United States Patent
Gelten et al.

(10) Patent No.: US 8,648,532 B2
(45) Date of Patent: Feb. 11, 2014

(54) COMPACT HID LAMP WITH MULTIPLE PROTECTIVE ENVELOPES

(75) Inventors: Ronald Johannes Gelten, Painted Post, NY (US); Alexander Dunaevsky, Pittsford, NY (US); Kathleen Bernard, Corning, NY (US)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/394,071

(22) PCT Filed: Jul. 30, 2010

(86) PCT No.: PCT/IB2010/053484

§ 371 (c)(1), (2), (4) Date: Mar. 2, 2012

(87) PCT Pub. No.: WO2011/027241

PCT Pub. Date: Mar. 10, 2011

(65) Prior Publication Data

US 2012/0153820 A1 Jun. 21, 2012

Related U.S. Application Data

(60) Provisional application No. 61/239,882, filed on Sep. 4, 2009.

(51) Int. Cl.
*H01J 61/30* (2006.01)

(52) U.S. Cl.
USPC ..... 313/634; 313/635; 313/243

(58) Field of Classification Search
USPC ..... 313/623–625, 634–636, 493, 318.12, 313/570, 578; 118/50; 445/26, 27
See application file for complete search history.

(56) References Cited

U.S. PATENT DOCUMENTS

| | | | | |
|---|---|---|---|---|
| 4,401,913 | A | 8/1983 | Koza | |
| 4,499,396 | A * | 2/1985 | Fohl et al. | 313/25 |
| 5,065,069 | A | 11/1991 | Hunter | |
| 5,079,480 | A | 1/1992 | Canale | |
| 6,133,677 | A | 10/2000 | Shippee | |
| 6,326,721 | B1 | 12/2001 | Shippee | |
| 6,614,188 | B1 | 9/2003 | Lindhout | |
| 2009/0267480 | A1 * | 10/2009 | Kawakatsu et al. | 313/312 |
| 2009/0278435 | A1 | 11/2009 | Sasai | |

FOREIGN PATENT DOCUMENTS

| | | | |
|---|---|---|---|
| EP | 2031634 | A1 | 3/2009 |
| FR | 1574750 | | 7/1969 |
| GB | 440138 | | 12/1935 |
| JP | 2009152171 | | 7/2009 |
| JP | 2009289524 | A1 | 12/2009 |
| WO | 2007088729 | A1 | 8/2007 |
| WO | 2008055543 | A1 | 5/2008 |
| WO | 2009017144 | A1 | 5/2009 |

* cited by examiner

*Primary Examiner* — Anh Mai
*Assistant Examiner* — Elmito Breval

(57) ABSTRACT

A High Intensity Discharge (HID) lamp includes a discharge chamber disposed within an anti-oxidation envelope and protected by a shroud. The shroud encloses the anti-oxidation envelope and thereby the discharge chamber to prevent the emission of fragments in the event that the discharge chamber fails. The shroud is positioned around the anti-oxidation envelope by a compressed spring at one end of the envelope tensioned against a collar attaching the other end of the envelope to a base of the lamp.

20 Claims, 7 Drawing Sheets

COMPACT HID LAMP WITH MULTIPLE PROTECTIVE ENVELOPES

This invention relates to the safe use of High Intensity Discharge (HID) lamps. HID lamps operate by sending an electric arc through a mixture of gases enclosed in light transmissive discharge chamber, typically of a quartz or ceramic material. The gases in the discharge chamber ionize and produce visible and ultra-violet light. The ionized gases may reach high pressures and generate heat. Due to the generated heat, lamp parts have to be prevented from oxidizing in open air. For that reason, an outer envelope made of glass or quartz surrounds the discharge chamber. The envelope holds a vacuum or can be filled with inert gas. If the discharge chamber were to fail hot fragments would be ejected. If the pressure inside the discharge chamber is sufficiently high, the velocity of these fragments may be high enough to puncture the outer envelope that surrounds the oxygen-free chamber. Thus, the fragments may possibly injure persons or damage property. This invention relates the attachment and positioning of a shroud for containing these fragments while allowing optimal operation of the lamp.

HID lamps can be enclosed in housing or exposed directly, so called "outside use". Exposed installation in a luminaire is considered to be outside use in this context. If the lamp is in a fully enclosed luminaire then the luminaire itself will prevent hot, high speed fragments from harming persons or property. The invention described here is for HID lamps which include a shroud to prevent the ejection of fragments.

HID lamps operate by sending electricity through a mixture of gases typically containing mercury and metal halide salts enclosed in a discharge chamber. The gases in the discharge chamber ionize, conduct electricity via an arc, and produce visible and ultra-violet light. The ionized gases can reach high pressures in some lamp types and generate heat. The discharge chamber may sustain high temperatures, and pressures for example, about 1000 degrees Celsius with pressures of 350 pounds per square inch (25 atmospheres) under standard operating conditions The discharge chamber is typically suspended by two axial leads that supply electricity to the envelope and whose ends internal to the discharge chamber produce the electric arc. If exposed to oxygen, rapid oxidation of the discharge chamber and the electric leads would occur. The discharge chamber is therefore disposed within an anti-oxidation envelope containing a vacuum or an inert gas. This inert environment, which is free of oxygen, prevents oxidation damage to the discharge chamber and the leads that would otherwise shorten the life of the lamp. This anti-oxidation envelope is usually constructed of materials that also filter out LTV light as this may be harmful to the persons using the lamp as a light source. Typically the discharge chamber is suspended by its leads within the anti-oxidation envelope.

It is possible to construct the anti-oxidation envelope of such material that it also acts to prevent the ejection of fragments from the lamp.

Another solution is to place an internal enclosure surrounding the discharge chamber inside the anti-oxidation envelope to prevent the emission of fragments. If the overall lamp construction is compact, there may not be sufficient space to insert this internal enclosure. Furthermore, internal enclosures significantly increase the temperature of the discharge chamber and therefore often require redesign of the discharge chamber in order to prevent adverse effects over the life of the lamp.

A third solution is described by patent WO 2007/08872.9 where a shroud is placed external to the anti-oxidation envelope to prevent the emission of hot, high speed particles. This patent describes a shroud glued to the base. This mechanical arrangement has a tendency to degrade over time as the glue is subject to the high temperatures of the lamp. The advantage of a glued construction is a very rigid fixation of all elements to the lamp base.

The HID lamp in accordance with the invention comprises three nested envelopes where the outer envelope is a shroud, the intermediate envelope provides ultraviolet light filtering and an anti-oxidation environment, and the innermost envelope is a discharge chamber containing ionized gas during operation. The lamp is connected to the power source via a base element that has, for example, a screw type or locking pin arrangement which makes electro-mechanical connections In one form of the invention, the anti-oxidation envelope is roughly cylindrical in shape and has a rounded end, which may have a cone shaped tip. The anti-oxidation envelope also has a mounting end. The anti-oxidation envelope permits the electrical leads connected to the discharge chamber to penetrate the mounting end of the envelope so that the leads can connect to the base element's external electrical terminals. The mounting end of the anti-oxidation envelope allows the passage of electrical leads and is fastened to the base element.

The anti-oxidation envelope in is in turn surrounded by a shroud preferably constructed of glass or quartz. However any transparent material of suitable mechanical and thermal properties can be used. The shroud retains any fragments that would be emitted in the event that the discharge chamber fails. Without a suitable shroud the HID lamp cannot be safely used in an exposed "outside" application. It is desirable to enable the use of the lamp "outside" without the use of a luminaire cover since it would allow minimization of the overall cost of the system and easy access to the lamp for replacement.

In one embodiment of the invention the shroud is cylindrically shaped. The shroud shape will preferably have a domed closed end and an open mounting end with the mounting end of the shroud being fastened to the base element via a peened collar. The domed top of the shroud is held in position via a spring which maintains a fixed distance between the anti-oxidation envelope and the shroud in both the axial and radial directions. The spring element, working in conjunction with the collar is used to achieve the mechanical objective of keeping the shroud optimally spaced away from the anti-oxidation envelope under conditions involving vibration and mechanical shocks. Typically these occur during shipping or high vibration use conditions such as installations on bridges. The spring element and collar are designed for minimal light blocking, while maintaining mechanical attachment and separation between glass/quartz parts which is long lived; other mechanisms such as the glue used in the WO 2007/08872.9 on the other hand, may degrade over time leading to a potential weakening of the attachment over the long life of some lamp types. The anti-oxidation envelope and thus the light source of the discharge chamber are centered inside the shroud for cosmetic reasons and for optimizing illumination from the lamp.

Exemplary embodiments of the invention will now be disclosed in more detail with reference to the figures, in which.

Throughout the figures, the same reference numerals are used for the same features.

Figure 1:
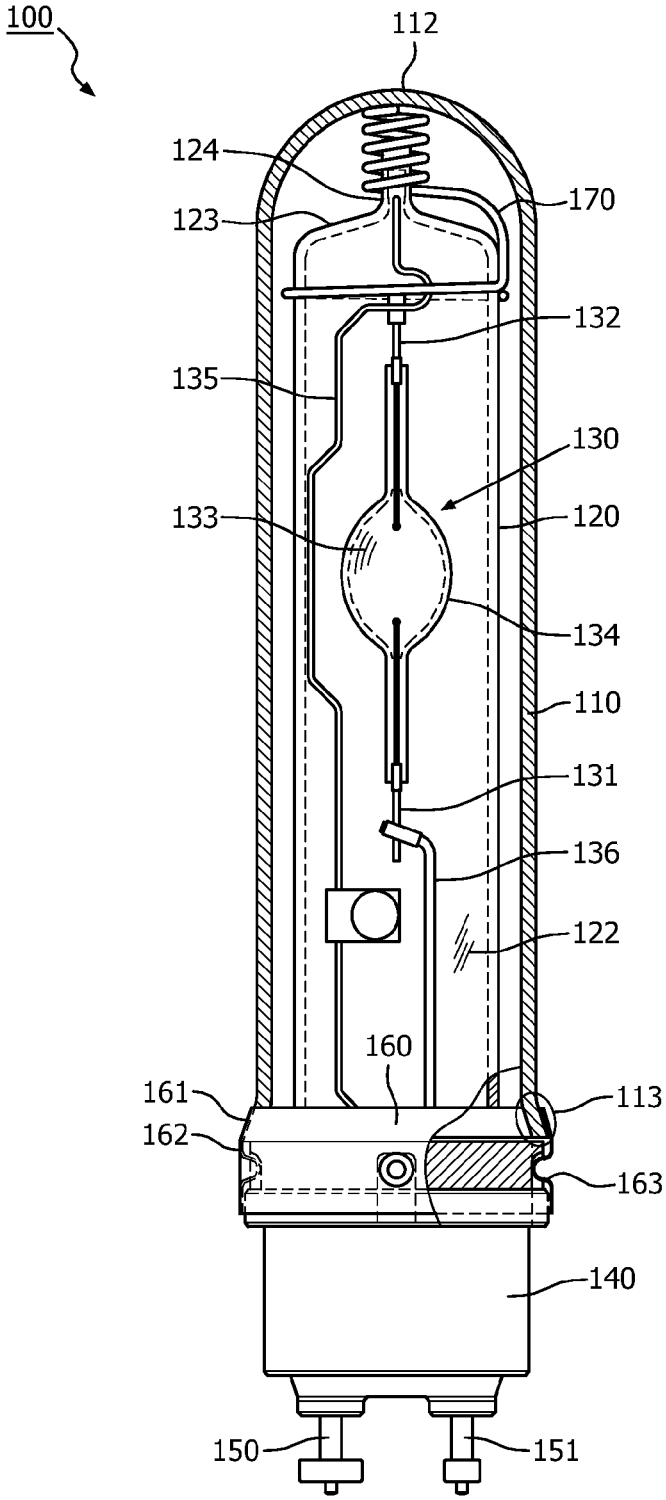
FIG. 1 shows a, cross section of a HID lamp with an external shroud and a cutaway section at the base
Figure 1A:
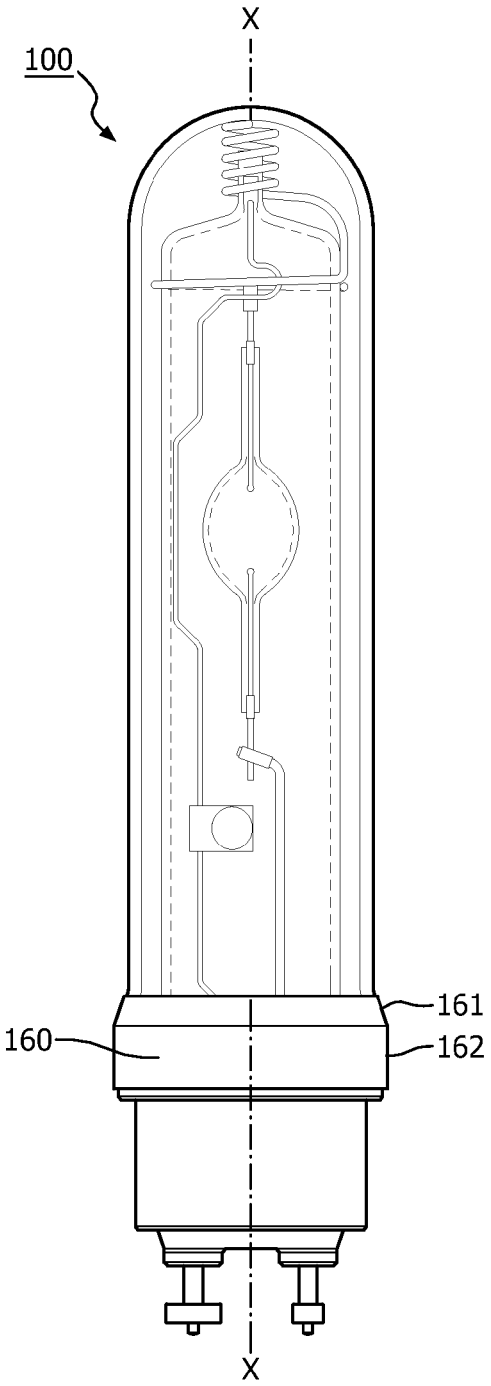
FIG. 1A shows a HID lamp with an opaque view of the collar and base.

FIGS. 1 and 1A show a lamp 100 comprising a discharge chamber 130, constructed of quartz or ceramic, although any suitable transparent material may be used, which during operation contains ionized gas 133 that emits light. The discharge chamber 130 is disposed within an anti-oxidation envelope 120 containing a vacuum or an inert gas 122. The anti-oxidation envelope 120 is disposed within a cylindrically shaped shroud 110. The longitudinal axis of the lamp is shown as axis X-X.

The discharge chamber 130 comprises a sealed pressure envelope 134 containing the gas 133 and two electrical leads 131 and 132. The discharge chamber 130 is mechanically suspended within the anti-oxidation envelope 120 via the electrical leads 131 and 132 and the suspension structure 135 and 136, consisting of electrically conductive support members, which also enables electrical connection through the anti-oxidation envelope 120 at the mounting end, to the terminals 150 and 151 of the lamp.

The anti-oxidation envelope 120 is cylindrical in shape and has a rounded end 123 with a longitudinally extending cone shaped tip 124 and a mounting end where electrical and mechanical connection is made to a base 140 as is well known in the art. The anti-oxidation envelope 120 containing the suspension structure 135 and 136 is sealed so that it may contain the vacuum or inert gas 122.

Figure 2:
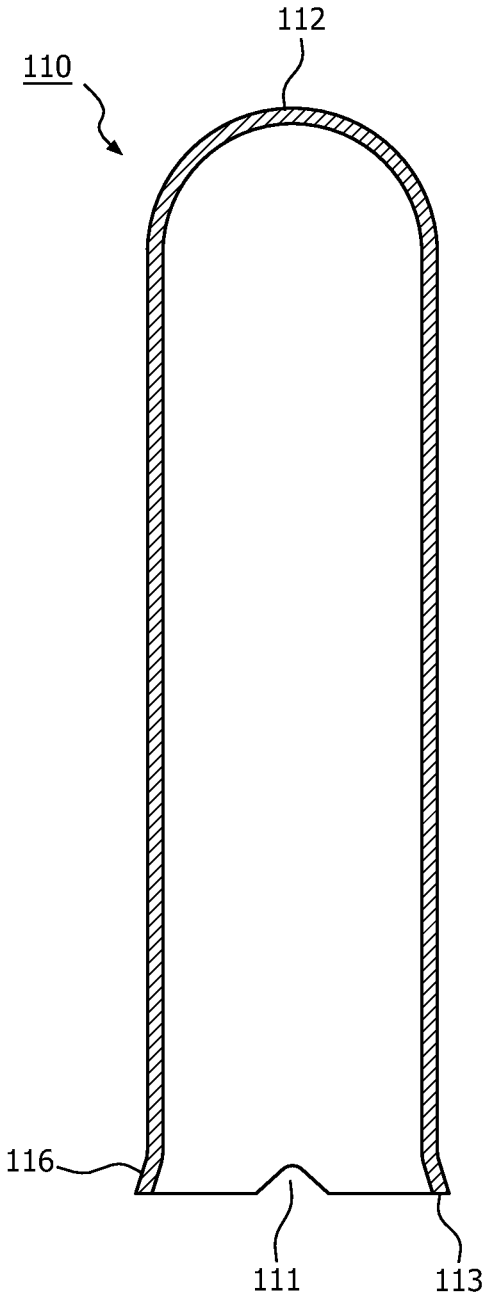
FIG. 2 shows the shroud.

The shroud 110, which surrounds the anti-oxidation envelope 120, comprises a domed end 112 and a flared mounting end 113 shown in the cutaway portion of the base and also in FIG. 2. The diameter of the flared mounting end 113 is approximately the same as the diameter of the base 140. The flared mounting end 113 contains one or more locating elements in the form of v-shaped notches 111 as shown in FIG. 2. Other shapes of notches are acceptable such as semicircular or rectangular notches. Other types of locating members may also be used. The flared mounting end 113 is attached to the base 140 via a collar 160 by use of a peening manufacturing step. The collar 160 is preferably comprised of a metal suitable for peening but other materials suitable for peening such as a deformable plastic may be used. One of the several peening dimples 163 is shown in the cutaway section.

A wire frame spring 170 is positioned between shroud 110 and anti-oxidation envelope 120. The combination of the collar 160 and the wire frame spring 170 keep the shroud 110 from being dislodged from its optimal position during normal use and shipping even in presence of external vibrations and mechanical shock. Specifically the collar 160 in conjunction with the spring 170 serves to keep the shroud 110 centered in both the longitudinal and radial direction about anti-oxidation envelope 120. Various types of springs may be used, some of which are illustrated in FIGS. 4-8.

The base 140 further contains the external electrical terminals 150 and 151 which are used to connect the lamp 100 to the electrical supply.

The collar 160 comprises a lower cylindrical section 162 which is shaped and dimensioned to snugly fit around the top portion of base 140 and has a tapered upper section 161 designed to fit over the domed end 112 of shroud 110 and capture the flared mounting end 113.

FIG. 2 schematically shows a shroud 110 with a domed end 112 and a flared mounting end 113. The mounting end 113 is captured by the collar 160 when the shroud 110 is fastened to the base 140. The mounting end 113 also contains at least one v-shaped notch 111. In the exemplary embodiment only a single notch is used.

Figure 3A:
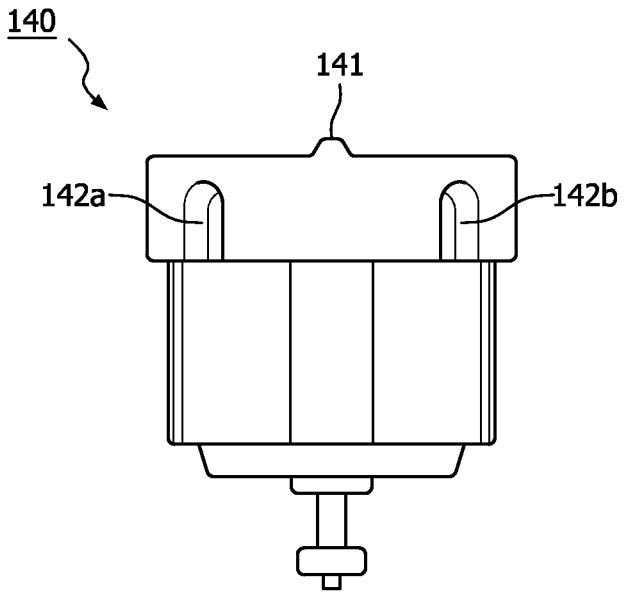
FIG. 3A shows the base of the lamp.
Figure 3B:
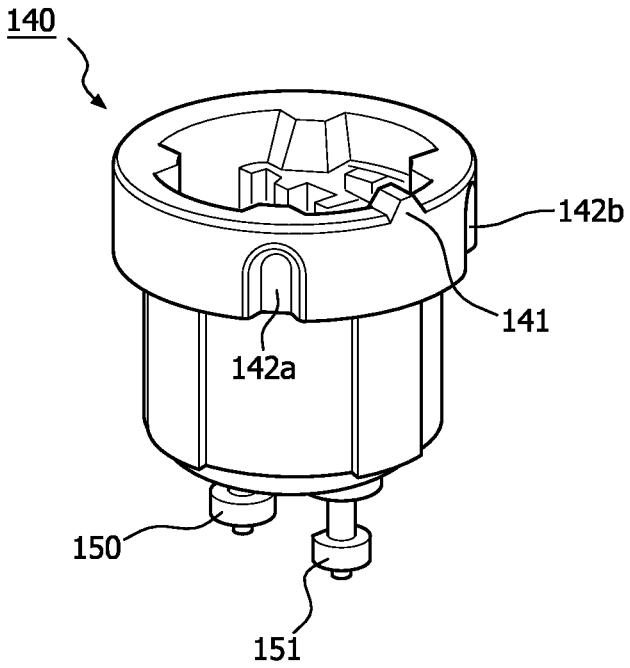
FIG. 3B shows another view of the base of the lamp.

FIG. 3*a* and FIG. 3*b* show an exemplary embodiment of the base 140 of the lamp. The lamp base 140 has a v-shaped projection 141 which matches the v-shaped notch 111 of the shroud 110 shown in FIG. 2. If more than one v-shaped notch 111 were contained in shroud 110, then more than one v-shaped projection 141 could be used, and would be aligned with the v-shaped notches 111 in shroud 110. The attachment of the shroud 110 to the base 140, with the notch 111 of the shroud 110 aligned with the projection 141 of the base 160 prevents the shroud 110 from rotating about the longitudinal axis X-X on the base 140 when the lamp 100 is twisted to insert its base into a luminaire or electrical receptacle.

The base 140 also contains one or more, but in this exemplary embodiment four, indentations 142 preferably disposed symmetrically about the top of the base 140. FIGS. 3A and 3B show only two of the indentations, 142*a*, 142*b*, but two more, 142*c*, 142*d* are located in similar positions on the hidden side of the base 140.

During attachment of the anti-oxidation envelope 120 to the base 140 the wire frame spring 170 is placed over the cone shaped tip 124 extending longitudinally from rounded end 123 of anti-oxidation envelope 120.

Thereafter, shroud 110 is placed over the rounded end 123 of anti-oxidation envelope 120 and the flared end 113 of the shroud is placed on the base 140, while aligning the v-shaped notch 111 in shroud 110 with v-shaped projection 141 and compressing the wire frame spring 170. Collar 160 is then placed over the shroud 110 so that the upper portion 161 of collar 160 captures the flare shaped end 113 of shroud 110 and the lower cylindrical portion 162 is snugly placed over the top of base 140. The collar 160 is then fastened in place by peening part of lower cylindrical portion 162 into the indentations 142 of base 140. The peening process thus fastens the shroud 110 to the base 140 via collar 160.

The combination of peened collar 160 together with the stabilization produced by compressed wire frame spring 170 maintain the optimum position of the shroud 110 about the anti-oxidation envelope 120 even in the presence of mechanical shocks and vibration. At the same time the spacing between the shroud 110 and the anti-oxidation envelope 120 maintained by collar 160 in conjunction with wire frame spring 170 ensure that neither the shroud 110 nor the anti-oxidation envelope 120 will be damaged as a result of shocks and vibration. Further the spring and collar arrangement blocks a minimal amount of light.

Figure 4:
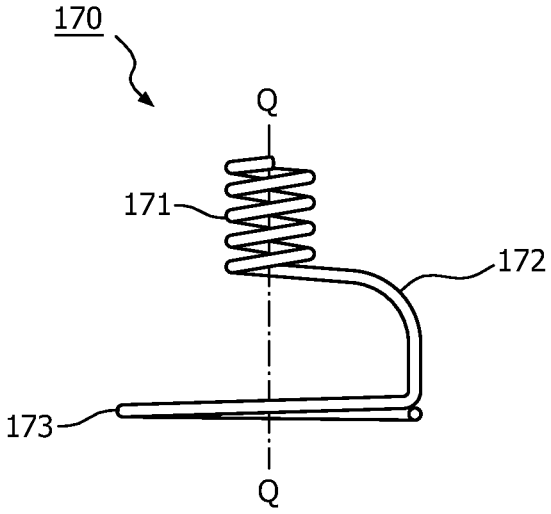
FIG. 4 shows an open frame spring embodiment in the transverse view.
Figure 5:
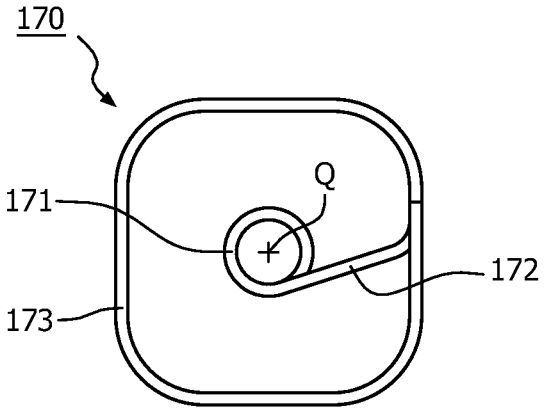
FIG. 5 shows the open frame spring embodiment of FIG. 4 in the top view.

FIG. 4 shows the transverse view of the wire frame spring 170, preferably comprised of a suitable wire, such as stainless steel, for the making of springs as is well known in the art. One end of the wire frame spring 170 includes a grasping member 173 shaped with an approximately square cross section with rounded corners as shown in FIG. 5. The grasping member is designed to pass at least once around the anti-oxidation envelope 120 and is sized so as to grasp the anti-oxidation envelope securely.

The end of the wire frame spring 170 opposite the grasping member 173 forms a helical member 171, with these two members being joined via an integral attachment member 172. The helical member 171 has one or more helical turns. The helical member 171 is positioned by the attachment member 172 so that both the grasping member 173 and helical member 171 center on the longitudinal axis X-X of the lamp. The inner diameter of the helical member 171 should be of sufficient size so that it is easily passed over the longitudinally extending cone shaped tip 124 of anti-oxidation envelope 120 and will rest securely on the rounded end 123 of the anti-oxidation envelope 120 so that the axis Q-Q of wire frame spring 170 is aligned with the axis X-X of the lamp 100.

FIG. 5 shows the top view of the wire frame spring 170 and illustrates the square cross section with rounded corners of the grasping member 173 and the position of the center of the helical member 171 over the center of the grasping member 173.

The wire frame spring 170 is shown with square cross section with rounded corners and a single turn around the anti-oxidation envelope 120, but many other configurations may be equally useful or even more useful given different circumstances and different materials for constructing the lamp components. For instance a hexagonal cross section with rounded corners could be used instead of square cross section for the grasping member 173. Alternatively sharp corners could be used. Likewise, several turns of wire around the anti-oxidation envelope 120 could be used if additional friction were needed. The turns around the anti-oxidation envelope could be an open or closed form where the coils are placed close to each other. Likewise the helical member 171 could comprise many turns or a single turn or even a small semi-circular strut.

Figure 6:
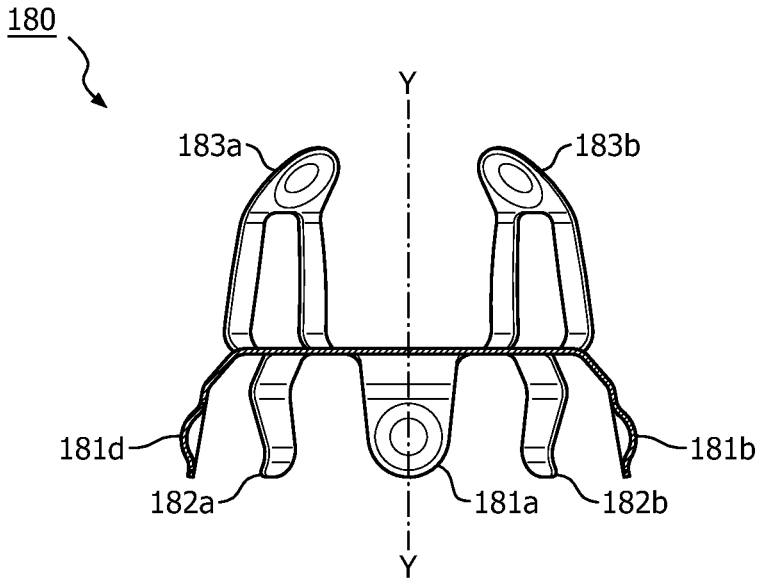
FIG. 6 shows a leaf spring embodiment in the transverse view.
Figure 7:
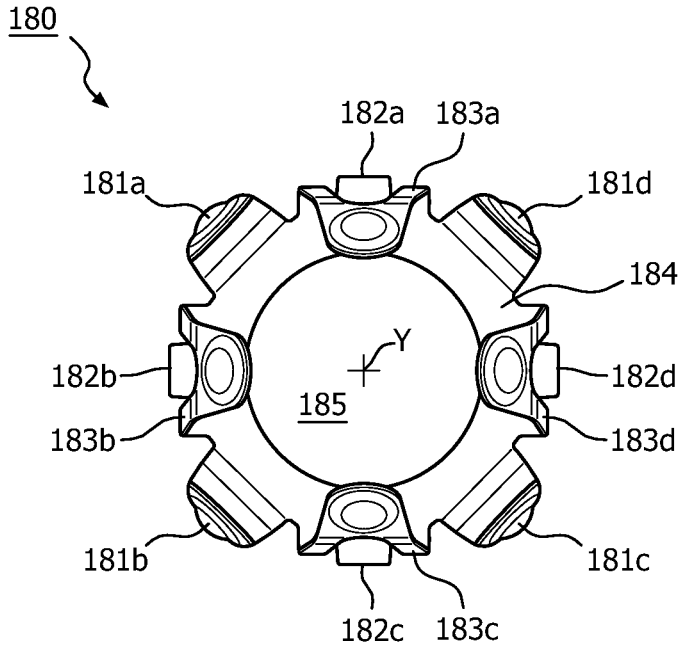
FIG. 7 shows the leaf spring embodiment of FIG. 6 in the top view.

FIGS. 6 and 7 show traverse and top views of a second embodiment of the spring, leaf spring 180 for attachment to the closed rounded end of the anti-oxidation envelope 120. Leaf spring 180 is comprised of spring material as is known in the art and is produced via conventional punching and forming steps.

Leaf spring 180 comprises an annular central member 184 to provide a structural base for parts of the leaf spring 180. Annular central member 184 defines a circular opening 185, centered on axis Y-Y. The diameter of circular opening 185 should be large enough to allow penetration of longitudinally extending cone shaped tip 124 of rounded end 123 of anti-oxidation envelope 120 and still allow annular central member 184 to rest securely on the rounded end 123 of the anti-oxidation envelope 120 with the axis Y-Y of the leaf spring 180 being coincident with the axis X-X of the lamp 100.

Extending from the annular central member 184 are three groups of integrally formed positioning members. A first group of lower spring members, 181*a*, 181*b*, 181*c* and 181*d* are symmetrically positioned around the axis Y-Y as best shown in FIG. 7. In between and preferably centered between lower spring members 181 and also extending from the annular central member 184 are grasping members 182*a*, 182*b*, 182*c* and 182*d* best shown in FIG. 7. Both the lower spring members 181 and grasping members 182 are bent down from the annular central member 184. The angle of bending from the flat center member 184 and the curvature of the lower spring members 181 are formed to ensure good contact with the walls of shroud 110 while the curvature of the grasping members 182 are formed to ensure good contact with the outer surface of anti-oxidation envelope 120.

A third group of upper spring members 183*a*, 183*b*, 183*c* and 183*d* extend from the annular central member 184 directly above grasping members 182*a*, 182*b*, 182*c*, and 182*d* respectively. The connection points of each upper spring member 183 straddle the connection point of each grasping member 182. All upper spring members 183 are bent up from the annular central member 184 in the opposite direction from grasping members 182. The angle of bending from the flat center member 184 and the curvature of the upper spring members 183 are formed to ensure that the upper spring members 183 are compressed by the domed end 112 of shroud 110 when the shroud 110 is placed correctly on base 140.

The leaf spring 180 is attached by placing the grasping members 182 snugly onto the rounded top 123 of anti-oxidation envelope 120. It is preferred that the leaf spring 180 should be placed so that the circular opening 185 is centered on narrow cone shaped tip 124 of rounded end 123 of anti-oxidation envelope 120 and the surface of annular central member 184 is in direct contact with the rounded end 123 of anti-oxidation envelope 120. Shroud 110 should be placed onto base 140 while simultaneously compressing upper spring members 183 and lower spring members 182 of leaf spring 180.

Although this description describes a leaf spring 180 with lower spring members 181 alternating with grasping members 182 and having upper spring members 183 directly above simple grasping members 182 other configurations may be used and may be more suitable depending on manufacturing or material parameters. For instance but without being exhaustive there may be fewer grasping members 182 or there may be additional members including types that are known in the art but now shown here. Likewise there may be fewer upper spring members 183 or different types of spring members or the upper spring members 183 may be attached to the flat centered member 184 at different points, for instance in between the lower spring members 181 and the grasping members 182. These variations and others similar variations are included within the scope of our invention.

Figure 8:
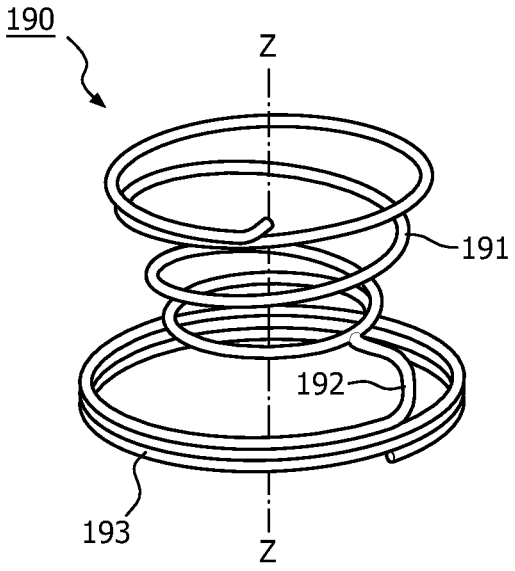
FIG. 8 shows an open spring embodiment.

FIG. 8 shows third embodiment of the spring, open spring 190 for attachment to the rounded end 123 of anti oxidation envelope 120 and preferably comprising of wire for the making of springs as is well known in the art. Open spring 190 comprises a spiral spring member 191 joined to a circular grasping coil 193 via intermediate integral attachment member 192. The grasping coil 193 is comprised of one or more turns of wire with an inner diameter designed to fit snugly around anti-oxidation envelope 120.

The spiral spring member 191 comprises one or more coils arranged in increasing diameters with the smallest coil being connected to the intermediate attachment member 192. The smallest coil diameter of spiral spring member 191 is such that it will fit around narrow cone shaped tip 124 of rounded end 123 of anti-oxidation envelope 120 and rest securely on the rounded end 123.

Ideally the intermediate attachment member 192 positions the centers of the coils of spiral spring member 191 directly over the center of the coils of grasping coil 193 with the axis X-X of the lamp 100 and the axis Z-Z of open spring 190 being coincident Open spring 190 is attached by placing the grasping coil 193 snugly onto the rounded top 123 of anti-oxidation envelope 120 with the smallest coil of spiral spring member 191 centered on narrow cone shaped tip 124 of rounded end 123 of anti-oxidation envelope 120 and in direct contact with the rounded end 123. Shroud 110 should be placed onto base 140 while simultaneously compressing the spiral spring member 191.

Although this description of open spring 190 includes a spiral spring member 191 other arrangements are also possible such as using a helical spring member in place of or to augment the spiral spring member 191. Likewise the spiral spring member 191 of open spring 190 could be used to replace or augment the helical member 171 of wire frame spring 170.

Although this description describes a cylindrically shaped lamp with a domed end and a base end other shapes are possible and often used such as bulbous cylinders, and lamps with two base ends. Likewise the lamp could have a hexagonal or square cross section as opposed to the round cross section described. Indeed it may be desirable to use different shapes for the various envelopes within various external shapes of the shroud. These variation and any other similar variations are included in our invention.

The invention claimed is:

1. A high intensity discharge lamp comprising:

a discharge chamber;

an anti-oxidation envelope disposed around said discharge chamber and having a first end fastened to a base;

a spring fitted to a second end of said anti-oxidation envelope, the second end of the anti-oxidation envelope being opposite the first end of the anti-oxidation envelope; and a shroud disposed around said anti-oxidation envelope, said shroud having a first end fastened to said base and a second end compressing said spring, wherein the spring includes a portion that extends up from the second end of the anti-oxidation envelope away from the base towards the second end of the shroud, and wherein the first end of the shroud fastened to said base has a flared mounting end extending outwards away from the anti-oxidation envelope, the flared mounting end forming an acute angle with an extended wall axis of the shroud extending from a wall of the shroud.

2. The high intensity discharge lamp as recited in claim 1, further comprising a collar for fastening said shroud to said base.

3. The high intensity discharge lamp as recited in claim 2, wherein said collar comprised of a peened fastening portion.

4. The high intensity discharge lamp as recited in claim 2, wherein said collar comprised of a crimped fastening portion.

5. The high intensity discharge lamp as recited in claim 1, wherein said spring comprises a wire frame spring.

6. The high intensity discharge lamp as recited in claim 1, wherein said spring comprises a leaf spring.

7. The high intensity discharge lamp as recited in claim 1, wherein said spring comprises an open spring.

8. The high intensity discharge lamp as recited in claim 1, wherein said spring and said collar cooperate to maintain a predetermined position of said shroud relative to said anti-oxidation envelope.

9. The high intensity discharge lamp of claim 1, wherein the spring comprises a further portion having an opening configured to receive the second end of the anti-oxidation envelope, the further portion being opposite the portion that extends up from the second end of the anti-oxidation envelope, and wherein the second end of the anti-oxidation envelope passing through the further portion and extending towards the second end of the shroud.

10. A high intensity discharge lamp comprising:

a discharge chamber with having a longitudinal axis of the discharge chamber coincident with a longitudinal axis of said lamp;

an anti-oxidation envelope disposed around said discharge chamber with a longitudinal axis of the anti-oxidation envelope coincident with the longitudinal axis of the lamp and having a first end fastened to a base;

a spring fitted to a second end of said anti-oxidation envelope, the second end of the anti-oxidation envelope being opposite the first end of the anti-oxidation envelope; and a shroud disposed around said anti-oxidation envelope with a longitudinal axis of the shroud coincident with said longitudinal axis of said lamp, having a first end fastened to said base and a second end compressing said spring, wherein the spring includes a portion that extends up from the second end of the anti-oxidation envelope away from the base towards the second end of the shroud, and wherein the first end of the shroud fastened to said base has a flared mounting end extending outwards away from the anti-oxidation envelope, the flared mounting end forming an acute angle with an extended wall axis of the shroud extending from a wall of the shroud.

11. The high intensity discharge lamp as recited in claim 10, further comprising a collar for fastening said shroud to said base.

12. The high intensity discharge lamp as recited in claim 11, wherein s said collar comprised of a peened fastening portion.

13. The high intensity discharge lamp as recited in claim 11, wherein said fastening portion comprises a crimped fastening portion.

14. The high intensity discharge lamp as recited in claim 10, wherein said spring is a wire frame spring.

15. The high intensity discharge lamp as recited in claim 14, wherein a longitudinal axis of said spring is centered on said longitudinal axis of said lamp.

16. The high intensity discharge lamp as recited in claim 10, wherein said spring is a leaf spring.

17. The high intensity discharge lamp as recited in claim 16, wherein an opening of said spring is centered on said longitudinal axis of said lamp.

18. The high intensity discharge lamp as recited in claim 10, wherein said spring is an open spring.

19. The high intensity discharge lamp as recited in the claim 18, wherein a longitudinal axis of said spring is centered on said longitudinal axis of said lamp.

20. The high intensity discharge lamp as recited in claim 10, wherein said spring and said collar cooperate to maintain a predetermined position of said shroud relative to said anti-oxidation envelope.

* * * * *